US008601738B2

(12) United States Patent
Weder et al.

(10) Patent No.: US 8,601,738 B2
(45) **Date of Patent: *Dec. 10, 2013**

(54) FLOWER POT COVER WITH INDENTED RING PORTION AND APPARATUS FOR FORMING SAME

(71) Applicants: Wanda M. Weder, Highland, IL (US); William F. Straeter, Highland, IL (US)

(72) Inventors: Donald E. Weder, Highland, IL (US); Michael J. King, Highland, IL (US)

(73) Assignee: Wanda M. Weder and William A. Straeter, Highland, IL (US), not individually but solely as Trustees of The Family Trust U/T/A dated Dec. 8, 1995

( * ) Notice: Subject to any disclaimer, the term of this patent is extended or adjusted under 35 U.S.C. 154(b) by 0 days.

This patent is subject to a terminal disclaimer.

(21) Appl. No.: 13/724,313

(22) Filed: Dec. 21, 2012

(65) Prior Publication Data

US 2013/0111853 A1 May 9, 2013

Related U.S. Application Data

(63) Continuation of application No. 13/253,207, filed on Oct. 5, 2011, now abandoned, which is a continuation of application No. 12/313,594, filed on Nov. 21, 2008, now Pat. No. 8,056,283, which is a continuation of application No. 11/475,348, filed on Jun. 27, 2006, now abandoned, which is a continuation-in-part of application No. 10/687,038, filed on Oct. 16, 2003, now abandoned.

(60) Provisional application No. 60/419,134, filed on Oct. 16, 2002.

(51) Int. Cl.
*A01G 9/02* (2006.01)
*B29C 51/16* (2006.01)

(52) U.S. Cl.
USPC ..... 47/72; 156/212

(58) Field of Classification Search
USPC ..... 47/72; 156/212, 215, 245
See application file for complete search history.

(56) References Cited

U.S. PATENT DOCUMENTS

| | | | |
|---|---|---|---|
| 1,735,721 | A | 11/1929 | Perez |
| 2,703,042 | A | 3/1955 | Goodwin |
| 4,297,811 | A | 11/1981 | Weder |
| 4,522,618 | A | 6/1985 | Stannard |
| 5,350,473 | A | 9/1994 | Weder et al. |
| 5,361,482 | A | 11/1994 | Weder et al. |
| 5,716,474 | A | 2/1998 | Weder et al. |
| 5,832,663 | A | 11/1998 | Weder et al. |
| 6,151,831 | A | 11/2000 | Weder et al. |

*Primary Examiner* — Monica Williams
(74) *Attorney, Agent, or Firm* — Dunlap Codding, P.C.

(57) ABSTRACT

An apparatus and method is provided for forming a flower pot cover with at least one indented portion to retain the flower pot cover on the flower pot.

20 Claims, 3 Drawing Sheets

FLOWER POT COVER WITH INDENTED RING PORTION AND APPARATUS FOR FORMING SAME

INCORPORATION BY REFERENCE STATEMENT

The entire contents of the following patents and patent applications are hereby expressly incorporated herein by reference: U.S. Ser. No. 13/253,207, filed Oct. 5, 2011; U.S. Ser. No. 12/313,594, filed Nov. 21, 2008, now U.S. Pat. No. 8,056,283, issued Nov. 15, 2011; U.S. Ser. No. 11/475,348, filed Jun. 27, 2006; U.S. Ser. No. 10/687,038, filed Oct. 16, 2003; and U.S. Ser. No. 60/419,134, filed Oct. 16, 2002.

FIELD OF THE INVENTIVE CONCEPT(S)

The presently disclosed and claimed inventive concept(s) relates generally to an article forming apparatus, and more particularly, but not by way of limitation, to an improved apparatus and method for forming an article, such as a flower pot cover having an indented ring portion from a sheet of material.

DETAILED DESCRIPTION OF THE INVENTIVE CONCEPT(S)

The presently disclosed and claimed inventive concept(s) is generally directed to an apparatus for forming an article having a predetermined shape from a sheet of material which is commonly referred to in the art as a "film." The sheet of material contemplated to be used with the presently disclosed and claimed inventive concept(s) is fabricated from a polymeric material selected from a group consisting of polypropylene, polyvinyl chloride, or combinations thereof. The sheet of material contemplated to be used with the presently disclosed and claimed inventive concept(s) is also relatively thin having a thickness in a range from about 0.5 mil to about 30 mil, and the sheet of material is very flexible and flimsy so that the sheet of material will not normally maintain or hold a predetermined formed shape (non-shape sustaining).

Figure 1:
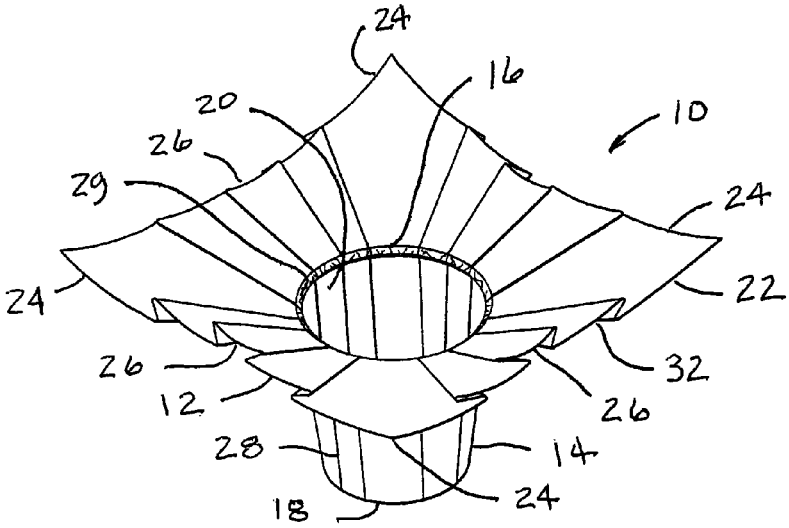
FIG. 1 is a perspective view of a flower pot cover constructed in accordance with the presently disclosed and claimed inventive concept(s).
Figure 2:
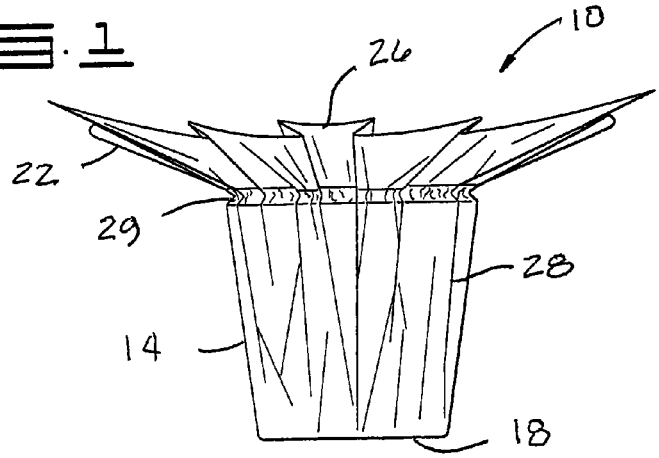
FIG. 2 is an elevational view of the flower pot cover of FIG. 1.
Figure 3:
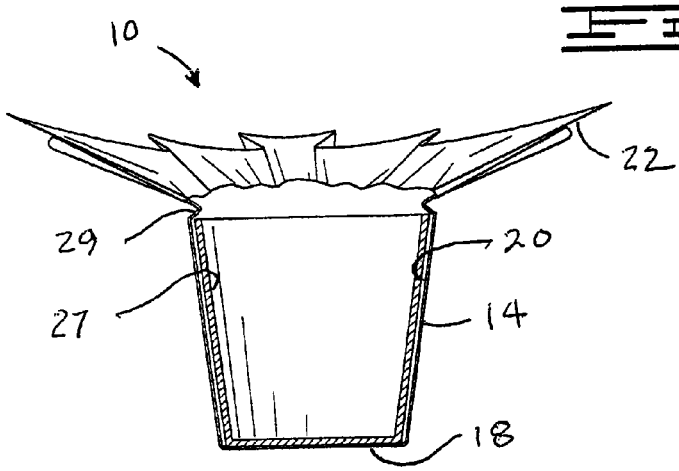
FIG. 3 is a cutaway, partial sectional view of the flower pot cover of FIG. 1 shown with a flower pot disposed therein.

FIGS. 1-3 illustrate a flower pot cover 10 preferably, although not exclusively, formed from a generally square-shaped sheet of material 12. The flower pot cover 10 includes a base 14 having an open upper end 16, a closed lower end 18, an object opening 20 extending through the upper end 16, and a decorative border or skirt 22 which extends at an angle upwardly and outwardly from the upper end 16 of the base 14. The decorative border 22 includes four accentuated and sculptured flared petal-like portions 24. Each flared petal-like portion 24 terminates with a pointed end which is formed by one of the four corners of the square-shaped sheet of material 12. Further, each flared petal-like portion 24 extends a distance at an angle upwardly and outwardly from the upper end 16 of the base 14 terminating with the pointed end of the flared petal-like portion 24. The flared petal-like portions 24 are spaced apart circumferentially about the decorative border 22 with the flared petal-like portions 24 being spaced apart at about ninety degree intervals, and a flare connecting portion 26 disposed between each pair of adjacent flared petal-like portions 24. Each of the flare connecting portions 26 extends a distance angularly upwardly and outwardly from the upper end 16 of the base 14 less than the distances which the pointed ends of the flared petal-like portions 24 extend from the upper end 16 of the base 14.

The object opening 20 of the flower pot cover 10 is shaped and sized to receive a flower pot 27 (FIG. 3). When the flower pot 27 is disposed in the object opening 20 of the flower pot cover 10, the base 14 substantially encompasses the outer peripheral surface of the flower pot 27 extending generally between the upper and the lower ends of the flower pot 27 with the upper end 16 of the base 14 being disposed generally near the upper end of the flower pot 27 and the lower end 18 of the flower pot cover 10 being disposed generally near the lower end of the flower pot 27. The closed lower end 18 of the flower pot cover 10 extends across and encompasses the lower end of the flower pot. When the flower pot cover 10 is disposed about the flower pot, the decorative border 22 of the flower pot cover 10 extends a distance angularly upwardly and outwardly from the upper end of the flower pot and the flower pot cover 10 extends generally circumferentially about the upper end of the flower pot.

The base 14 of the flower pot cover 10 includes a plurality of longitudinal, overlapping folds 28 (only some of the overlapping folds 28 being designated by a reference numeral in the drawings). Substantial portions of the overlapping folds 28 extend at angles to a vertical direction and at angles to a horizontal direction, the various angles being arbitrary and varying from one overlapping fold 28 to another overlapping fold 28. Further, the base 14 includes a plurality of overlapping folds 28 with the various overlapping folds 28 being positioned at various positions about the entire outer peripheral surface of the base 14 and at various positions between the upper and the lower ends 16 and 18 of the base 14. The overlapping folds 28 provide an overall decorative appearance to the base 14. However, more significantly, the overlapping folds 28 provide mechanical strength to the base 14 for enabling the base 14 to stand upright (substantially retain the shape formed by the apparatus of the presently disclosed and claimed inventive concept(s) described below) on the closed lower end 18 of the base 14. In this manner, the base 14 of the flower pot cover 10 has sufficient mechanical strength to stand upright about a flower pot without the necessity of mechanically connecting the base 14 to a flower pot, other than the connection normally provided when the lower end of a flower pot engages the lower end 18 of the flower pot cover 10 when the flower pot cover 10 is disposed about a flower pot.

Each overlapping fold 28 extends an arbitrary distance and most of the overlapping folds 28 extend at arbitrary angles over the base 14. This structure enhances the mechanical strength of the base 14, as compared to the mechanical strength which might be imparted to the base 14 by overlapping folds extending only in vertical or horizontal directions. Significantly, the overlapping folds 28 permit relatively thin sheets (films) of material to be utilized to form the decorative flower pot cover 10 in a manner and for reasons to be discussed further below.

The base 14 is further shown to have at least one indented portion 29, such as an indented ring portion, at the upper end of the base 14. The indented portion 29 serves to retain the flower pot cover 10 on the flower pot 27. The indented portion 29 extends about the base 14 and inwardly a distance sufficient to extend over the upper rim of the flower pot 27. While FIG. 2 illustrates a continuous indented ring portion, it is to be understood that the scope of the presently disclosed and claimed inventive concept(s) includes the use of a single indentation or a plurality of indentations, such as one or more dimples formed on a golf ball, as well as other shapes, including but not limited to, one or more segments or arcs of indented portions that may form a continuous or semi-continuous ring portion.

The sheet of material 12 has an upper surface 30 and a lower surface 32, and either the upper surface 30 or the lower surface 32 or both the upper surface 30 and the lower surface 32 are adapted to be bondable so that when portions of the bondable surface are brought into bondable contact, such portions are bondably connected. The overlapping folds 28 are formed by overlapping portions of the bondable surface and bringing such overlapping portions into bondable engagement or contact. In this manner, the overlapping folds 28 are permanently fixed in the flower pot cover 10. When an overlapping fold 28 is formed with a portion of the sheet of material 12 during the forming of the flower pot cover 10, portions of the upper surface 30 are overlapped and brought into bondable contact or engagement and, with respect to the same overlapping fold 28, portions of the lower surface 32 also are overlapped and brought into bondable contact or engagement.

As mentioned before, at least one of the upper and the lower surfaces 30 and 32 is prepared to form a bondable surface which is adapted to be bonded to portions of a similar bondable surface when bondably contacted with a similar bondable surface portion. Thus, in those instances when only the lower surface 32 is prepared to form a bondable lower surface 32, the overlapping portions of the bondable lower surface 32 are brought into bondable contact during the forming of the flower pot cover 10 and such overlapping portions are bonded to form the overlapping folds 28. The corresponding overlapping portions of the upper surface 30 are not bonded. Similarly, in those instances when only the upper surface 30 is prepared to form a bondable upper surface 30, the overlapping portions of the bondable upper surface 30 are brought into bondable contact during the forming of the flower pot cover 10 and such overlapping portions are bonded to form the overlapping folds 28. The corresponding overlapping portions of the lower surface 32 are not bonded. Finally, in those instances when both the upper and the lower surfaces 30 and 32 are prepared to form bondable upper and lower surfaces 30 and 32, the overlapping portions of the upper and the lower surfaces 30 and 32 forming each overlapping fold 28 are brought into bondable contact during the forming of the flower pot cover 10 and such overlapping portions of the upper and the lower surfaces 30 and 32 are bonded to form the overlapping folds 28.

It has been found to be necessary only to prepare one of the upper and the lower surfaces 30 or 32 to form a bondable surface so the flower pot cover 10 is formable from the film sheet of material 12 having sufficient mechanical strength to retain its formed shape in accordance with the presently disclosed and claimed inventive concept(s). However, it should be noted that preparing both the upper and the lower surfaces 30 and 32 to form bondable surfaces provides additional mechanical strength which may be desired in some applications and particularly in those applications where the additional mechanical strength is needed to enable the formed article to maintain or retain its formed shape. Such additional strength may be desired either because of the particular shape of the article or the particular thickness or characteristics of the particular film forming the sheet of material 12. Various techniques are utilized to prepare the sheet of material 12 with at least one bondable surface in accordance with the presently disclosed and claimed inventive concept(s).

One technique for preparing the bondable surfaces is to utilize polyvinyl chloride film to form the sheet of material 12 which is heat sealable. When utilizing a processed organic polymer heat sealable film, the upper and the lower surfaces 30 and 32 of the sheet of material 12 are bondable surfaces and the sheet of material 12 must be heated during the forming of the article or, more particularly, the forming of overlapping folds 28. Thus, in this instance, the term "bondable contact" or "bondable engagement" means contacting engagement and the application of the required amount of heat to effect heat sealable bonding of the contacting surfaces.

It should be noted that a light activated adhesive also is suitable for use in preparing the bondable surface in accordance with the presently disclosed and claimed inventive concept(s). In this instance, heating elements would not be necessary. However, means for lighting the areas to be bonded would be necessary which might be affected by utilizing a light source during the forming of the flower pot cover 10. In this instance, the term "bondable contact" or "bondable engagement" means contacting engagement and the applications of sufficient light to affect the bond.

Another technique for preparing the bondable surfaces is to utilize a non-heat sealable film to form the sheet of material 12 and to apply a heat sealable coating to either the upper surface 30 or the lower surface 32 or both. Heat sealable adhesives are commercially available. The term "bondable contact" or "bondable engagement" as used in this instance means contacting engagement and the application of the required amount of heat to affect heat sealable bonding of the contacting surfaces. The heat sealable coating also can be a heat sealable lacquer, a pressure sensitive adhesive which also requires heat to effect the bond, or a non-melt adhesive.

An additional technique for preparing the bondable surfaces 30 or 32 is to utilize a non-heat sealable film to form the sheet of material 12 and to apply a contact adhesive coating to either the upper surface 30 or the lower surface 32 or both. Contact adhesives are commercially available. The term "bondable contact" or "bondable engagement" in this instance means contacting engagement sufficient to affect the adhesive bond between the contacted surfaces.

For aesthetic purposes, it is preferable that the decorative border 22 and particularly the flared petal-like portions 24 remain substantially smooth and substantially free of the overlapping folds. Also, it is desirable that the flare connecting portions 26 also remain substantially smooth and substantially free of overlapping folds.

Figure 4:
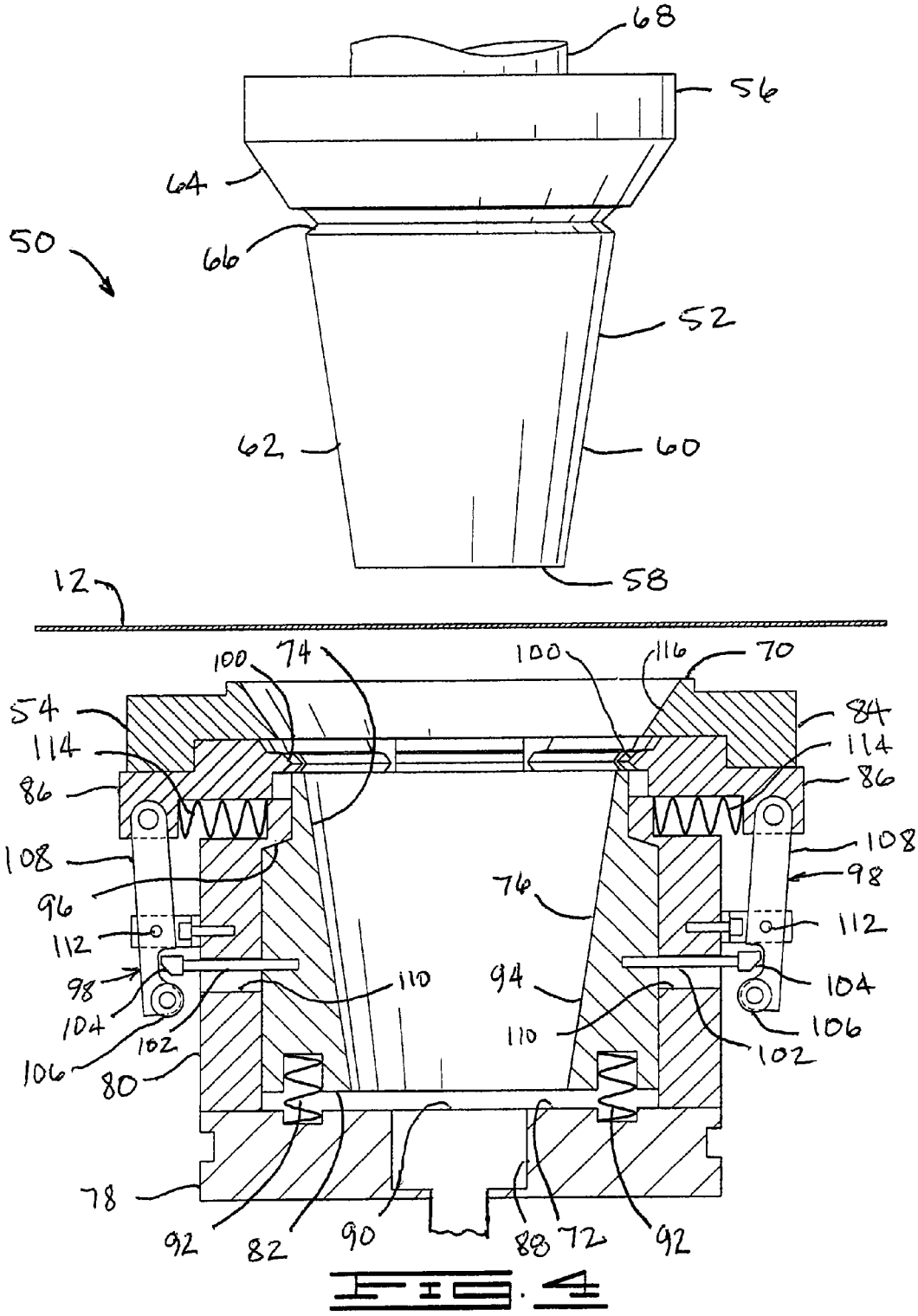
FIG. 4 is a cross sectional view of a molding apparatus constructed in accordance with the presently disclosed and claimed inventive concept(s) for forming the flower pot cover of FIG. 1
Figure 5:
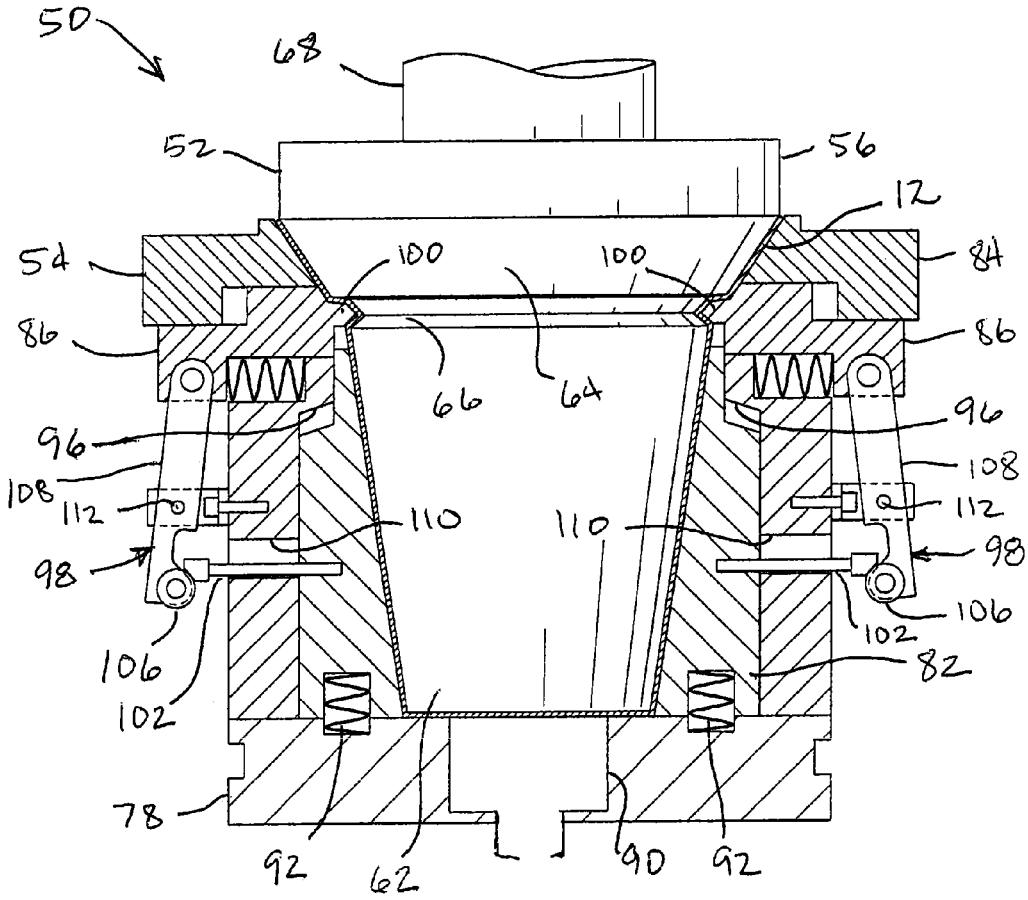
FIG. 5 is a cross sectional view of the molding apparatus of FIG. 4 shown with a male die engaged with the female die.

Referring now to FIGS. 4 and 5, a molding apparatus 50 for forming the flower pot cover 10 is shown. The molding apparatus 50 is adapted to form the sheet of material 12 into an article, such as the flower pot cover 10. Broadly, the molding apparatus 100 includes a male die 52 and a female die 54.

The male die 52 is shaped and sized to formingly mate with the female die 54 during the forming of an article, such as the flower pot cover 10. The male die 52 is characterized as having an upper end 56, a lower end 58, and a male die surface 60. The male die surface 60 extends a distance generally from the lower end 58 toward the upper end 56 of the male die 52. A portion of the male die surface 60 forms a base portion 62 of the male die surface 60. The base portion 62 of the male die surface 60 has an outer peripheral surface which is shaped about the same as the outer peripheral surface of a flower pot; the dimensions of the base portion 62 being slightly larger than the comparable dimensions of the outer peripheral surface of a flower pot so that a flower pot cover formed by the molding apparatus 50 of the presently disclosed and claimed inventive concept(s) will fit generally about the outer peripheral surface of the flower pot when the flower pot cover is disposed about the flower pot.

The base portion 62 has an upper end and a lower end. The base portion 62 of the male die surface 60 generally is frustoconically shaped with the diameter of the base portion 62 generally at the lower end being smaller than the diameter of the base portion 62 generally at the upper end of the base portion 62. The male die surface 60 also includes a flared portion 64 which flares a distance angularly outwardly and upwardly from the upper end of the base portion 62. The flared portion 64 of the male die surface 60 is characterized as having an upper end and a lower end with the lower end thereof being connected to the upper end of the base portion 102. The lower end of the flared portion 64 is provided with an annular recess 66.

A plurality of openings (not shown) may be formed through the male die 52 with each opening extending through the male die surface 60. The openings are connected to the blower (not shown) and a vacuum source (not shown) in a manner well known in the art such that fluid communication is established between the openings and the blower and the openings and the vacuum source.

A heater element (not shown) may be secured to the upper end 56 of the male die 52 to heat the male die surface 60 to a predetermined temperature level during the operation of the molding apparatus 50. The heater element is connected to an electrical power source. A temperature sensing device (not shown) is positioned in the male die 52 and connected to the electrical power source to sense the temperature level of the male die surface 60 and maintain the temperature level of the male die surface 60 at a desired predetermined temperature level.

The male die 52 is supported above the female die 54 by a cylinder 68 whereby the male die 52 is movable between a discharge position (FIG. 4) and a forming position (FIG. 5). In the discharge position, the male die 52 is removed from the female die 54 so that the sheet of material 12 can be positioned between the male die 52 and the female die 54 and so that a formed article, such as the flower pot cover 10, is removable from the male die 52. In the forming position, the male die 56 is matingly disposed into the female die 54.

The female die 54 is secured to a support frame (not shown) and is characterized as having an upper end 70, a lower end 72, and an opening 74 formed through the upper end 70 of the female die 54 extending a distance generally toward the lower end 72 of the female die 54. The opening 74 is defined by a female die surface 76.

The female die 54 includes a base section 78, a middle section 80, a sliding section 82, a top section 84, and a plurality of fingers 86 adapted to be received in the annular recess 66 of the male die 52. The base section 78 is generally circularly shaped with a central opening 88 for receiving a plunger 90 for assisting in the removal of the flower pot cover 10 from the female die 54. The sliding section 82 is positioned within the middle section 80, which is rigidly connected to the base section 78, and the sliding section 82 is biasingly supported on the base section 78 by a plurality of springs 92. The sliding section 82 is adapted to move between an internal shoulder 96 of the middle section 80 and an upper surface of the base section 78. The sliding section 82 has a generally frustoconically shaped inner surface 94 that coincides with the female die surface 76. The sliding section 82 may be provided with a plurality of openings (not shown) formed in the female die surface 76. The openings are connected to a blower (also not shown) such that fluid communication is established between the openings and the blower.

The fingers 86 are positioned between the middle section 80 and the top section 84 and spaced uniformly about a circumference of the female die 54. Each of the fingers 86 is connected to an actuator assembly 98 to move the fingers 86 radially inward in response to downward movement of the sliding section 82. Each of the fingers 86 has an arcuate nub 100 with each arcuate nub 100 having substantially the same curvature as the curvature of the recess 66 of the male die 52. Each of the fingers 86 is preferably heated to facilitate formation of the at least one indented portion 29 of the flower pot cover 10. The fingers 86 are sized and arranged to merge to form at least one indented portion in the flower pot cover 10 when the fingers 86 are moved inwardly into the recess 66 of the male die 52. However, as mentioned above, it is also contemplated that the fingers 86 may be annularly spaced so that the indented portion 29 is formed as segments of indented portions.

Each actuator assembly 98 includes a cam 102 rigidly attached at one end to the sliding section 82 so that the cam 102 moves with the sliding section 82. A cam surface 104 located at the other end of the cam 102 is adapted to engage a cam follower or roller 106 attached to one end of a pivot arm 108. The cam 102 extends from the sliding section 82 and through a cam slot 110. The pivot arm 108 pivots about a pivot pin 112 that is rigidly attached with respect to the middle section 80. An opposite end of the pivot arm 108 is pivotally attached to a corresponding finger 86. A spring 114 is positioned between the middle section 80 and each of the fingers 86 so as to outwardly bias the fingers 86 when the male die 52 is in the discharge position.

The top section 84 is connected to the middle section 80 and includes a flared portion 116 corresponding to the flared portion 64 of the male die 52 for forming the decorative border 22 of the flower pot 10.

A heater element (not shown) may be secured to the lower end 72 of the female die 54 to heat the female die surface 76 to a predetermined temperature level during the operation of the molding apparatus 50. The heater element is connected to the electrical power source. A temperature sensing device (not shown) is positioned in the female die 54 and connected to the electrical power source to sense the temperature level of the female die surface 76 and maintain the temperature level of the female die surface 76 at a desired predetermined temperature level.

As the male die 52 moves in a downward direction, the male die 52 moves to a position wherein the lower end 58 of the male die 52 initially engages the portion of the sheet of material 12 disposed over the opening 74 in the female die 54. The male die 52 continues to move in the downward direction to the forming position wherein the male die surface 60 is matingly disposed with the female die 54 with the lower end 58 of the male die 52 being disposed generally near the lower end of the sliding section 82 with portions of the sheet of material 12 being disposed generally about the male die surface 60 and generally between the male die surface 60 and the female die surface 76.

As the male die 52 continues to move downwardly, a downward force is exerted on the sliding section 82 sufficient to overcome the bias of spring 92. Thus, the sliding section 82 moves downwardly toward the base section 78, thereby causing the cams 102 to move downwardly and causing the cam surface 104 to engage the cam followers 106. In turn, the pivot arms 108 rotate so as to cause the fingers 86 to move radially inwardly into the recess 66 of the male die 52.

In the forming position of the male die 52, the sliding portion 82 of the female die 54 cooperates with the base portion 62 of the male die 52 to form the portion of the sheet of material 12 disposed therebetween into the base 14 of the flower pot cover 10. The flared portion 116 of the female die 54 cooperates with the flared portion 64 of the male die 52 to form the portion of the sheet of material 12 disposed therebetween into the lower portion of the decorative border 22 generally adjacent the upper end of the base 14, thereby establishing or forming the angle at which the decorative border 22 extends upwardly and outwardly from the opened upper end 16 of the base 14. Finally, the fingers 86 of the female die 54 cooperate with the recess 66 of the male die 52 to form the indented portion 29 of the flower pot cover 10.

Upon the expiration of a predetermined dwell time, the vacuum and blower are activated in the male die 52 and female die 54, respectively, and the cylinder 68 is caused to retract. The retraction of the cylinder 68 removes the male die 52 from the female die 54 with the formed flower pot cover 10 disposed on the male die 52.

The term "polymer film" as used herein means a man-made polymer such as a polypropylene or a naturally occurring polymer such as cellophane. A polymer film is relatively strong and not as subject to tearing (substantially non-tearable), as might be the case with paper or foil.

The sheets of material 12 described herein may be constructed of a single layer of material or a plurality of layers of the same different types of materials. Any thickness of the sheet of material 12 may be utilized in accordance with the presently disclosed and claimed inventive concept(s) as long as the sheet of material 12 may be formed into a preformed pot cover with a skirt or decorative border, as described herein. The layers of material comprising the sheet of material 12 may be connected together or laminated or may be separate layers, and the layers of material comprising the sheet of material 12 need not be uniform in shape or composition.

Any thickness of the sheet of material 12 may be utilized in accordance with the presently disclosed and claimed inventive concept(s) as long as the sheet of material 12 may be formed into a flower pot cover, as described herein. Additionally, an insulating material such as bubble film, preferable as one of two or more layers, can be utilized in order to provide additional protection for the item wrapped therein.

A decorative pattern, such as a color and/or an embossed pattern, and/or other decorative surface ornamentation may be applied to the inner peripheral surface and/or the outer peripheral surface of the sheet of material 12 or cover or portions thereof including, but not limited to printed design, coatings, colors, flocking or metallic finishes. The sheet of material 12 also may be totally or partially clear or tinted transparent material.

The term plant or "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "floral grouping" where used herein, means cut fresh flowers, artificial flowers, a single flower, other fresh and/or artificial plants or other floral materials and may include other secondary plants and/or ornamentation or artificial or natural materials which add to the aesthetics of the overall floral arrangement. The floral grouping comprises a bloom or foliage portion and a stem portion. However, it will be appreciated that the floral grouping may consist of only a single bloom or only foliage (not shown). The term "floral grouping" may be used interchangeably herein with the term "floral arrangement".

The term "flower pot cover" when used herein also means a decorative cover or simply a cover.

The term "flower pot" as used herein also means a pot, a plant pot, or a container. The flower pot may contain a floral grouping, a growing medium, a propagule or any other botanical item.

From the above description it is clear that the presently disclosed and claimed inventive concept(s) is well adapted to carry out the objects and to attain the advantages mentioned herein as well as those inherent in the presently disclosed and claimed inventive concept(s). While presently preferred embodiments of the presently disclosed and claimed inventive concept(s) have been described for purposes of this disclosure, it will be understood that numerous changes may be made which will readily suggest themselves to those skilled in the art and which are accomplished within the spirit of the inventive concept(s) disclosed and as defined in the appended claims.

What is claimed is:

1. A method of decoratively covering a pot, comprising the steps of:

forming a flower pot cover from a sheet of material using an apparatus, the preformed flower pot cover comprising a base having an open upper end, a lower end, and an object opening shaped and sized to receive a flower pot, the preformed flower pot cover further comprising a skirt extending at an angle upwardly and outwardly from the open upper end of the base and at least one indented portion for retaining the flower pot cover about a flower pot, the at least one indented portion located between the base and the skirt and extending inwardly into a portion of the object opening of the base prior to disposing the flower pot within the preformed flower pot cover, and wherein the apparatus for forming the flower pot cover comprises:

a female die having an upper end, a lower end, and an opening intersecting the upper end and extending a distance toward the lower end forming an inner female die surface, the female die having a plurality of fingers movable radially into the opening; and a male die having an upper end, a lower end, and an outer male die surface extending a distance generally between the lower end and the upper end of the male die, the male die shaped such that at least a portion of the male die is receivable in the opening of the female die, the male die and the female die movable relative to one another between a discharge position wherein the male die is removed from the opening of the female die such that the sheet of material is positionable between the male die and the female die and a forming position wherein at least a portion of the male die is disposed in the opening of the female die so as to form the flower pot cover from the sheet of material positioned between the male die and the female die, the male die having a recess formed between the lower end and the upper end of the female die and adapted to receive the fingers of the female die to form the at least one indented portion of the flower pot when the sheet of material is pressed between the female die and the male die;

disposing a flower pot having an upper rim into the object opening of the preformed flower pot cover, wherein the upper rim of the flower pot is disposed below the upper end of the base of the preformed flower pot cover; and wherein the at least one indented portion extends inwardly into the object opening a distance sufficient to extend over the upper rim of the flower pot, thereby retaining the preformed flower pot cover on the flower pot.

2. The method of claim 1, wherein the at least one indented portion of the preformed flower pot cover is an indented ring portion.

3. The method of claim 2, wherein the indented ring portion is a continuous ring portion.

4. The method of claim 1, wherein the at least one indented portion of the preformed flower pot cover comprises at least two indented segments, wherein the at least two indented segments form an indented ring portion.

5. The method of claim 1, wherein the at least one indented portion of the preformed flower pot cover is a single indentation.

6. The method of claim 1, wherein the lower end of the base of the preformed flower pot cover is closed.

7. The method of claim 1, wherein the base of the preformed flower pot cover comprises a plurality of overlapping folds.

8. The method of claim 7, wherein the skirt of the preformed flower pot cover is free of overlapping folds.

9. The method of claim 1, wherein the preformed flower pot cover is formed of a plurality of layers of material.

10. The method of claim 1, wherein the preformed flower pot cover further comprises a decorative pattern disposed on at least a portion thereof.

11. A method of decoratively covering a pot, comprising the steps of:

forming a flower pot cover from a sheet of material using an apparatus, the preformed flower pot cover comprising a base having an open upper end, a closed lower end, and an object opening shaped and sized to receive a flower pot, the preformed flower pot cover further comprising a skirt extending at an angle upwardly and outwardly from the open upper end of the base and at least one indented ring portion for retaining the flower pot cover about a flower pot, the at least one indented ring portion located between the base and the skirt and extending inwardly into a portion of the object opening of the base prior to disposing the flower pot within the preformed flower pot cover, and wherein the apparatus for forming the flower pot cover comprises:

a female die having an upper end, a lower end, and an opening intersecting the upper end and extending a distance toward the lower end forming an inner female die surface, the female die having a plurality of fingers movable radially into the opening; and a male die having an upper end, a lower end, and an outer male die surface extending a distance generally between the lower end and the upper end of the male die, the male die shaped such that at least a portion of the male die is receivable in the opening of the female die, the male die and the female die movable relative to one another between a discharge position wherein the male die is removed from the opening of the female die such that the sheet of material is positionable between the male die and the female die and a forming position wherein at least a portion of the male die is disposed in the opening of the female die so as to form the flower pot cover from the sheet of material positioned between the male die and the female die, the male die having a recess formed between the lower end and the upper end of the female die and adapted to receive the fingers of the female die to form the at least one indented ring portion of the flower pot when the sheet of material is pressed between the female die and the male die;

disposing a flower pot having an upper rim into the object opening of the preformed flower pot cover, wherein the upper rim of the flower pot is disposed below the upper end of the base of the preformed flower pot cover; and wherein the at least one indented ring portion extends inwardly into the object opening a distance sufficient to extend over the upper rim of the flower pot, thereby retaining the preformed flower pot cover on the flower pot.

12. The method of claim 11, wherein the indented ring portion is a continuous ring portion or is formed of at least two indented segments.

13. The method of claim 11, wherein the base of the preformed flower pot cover comprises a plurality of overlapping folds.

14. The method of claim 11, wherein the preformed flower pot cover is formed of a plurality of layers of material.

15. An apparatus for forming a flower pot cover from a sheet of material, the flower pot cover having at least one indented portion for retaining the flower pot cover on a flower pot, the apparatus comprising:

a female die having an upper end, a lower end, and an opening intersecting the upper end and extending a distance toward the lower end forming an inner female die surface, the female die having a plurality of fingers movable radially into the opening;

a male die having an upper end, a lower end, and an outer male die surface extending a distance generally between the lower end and the upper end of the male die, the male die shaped such that at least a portion of the male die is receivable in the opening of the female die, the male die and the female die movable relative to one another between a discharge position wherein the male die is removed from the opening of the female die such that the sheet of material is positionable between the male die and the female die and a forming position wherein at least a portion of the male die is disposed in the opening of the female die so as to form the flower pot cover from the sheet of material positioned between the male die and the female die, the male die having a recess formed between the lower end and the upper end of the female die and adapted to receive the fingers of the female die to form the at least one indented portion of the flower pot when the sheet of material is pressed between the female die and the male die; and wherein the flower pot cover formed by the apparatus comprises a base, a skirt, and at least one indented portion, the base having an open upper end, a lower end and an object opening shaped and sized to receive a flower pot, the skirt extending at an angle upwardly and outwardly from the open upper end of the base, and the at least one indented portion extending inwardly into a portion of the object opening of the base a distance sufficient to extend over an upper rim of a flower pot when the flower pot is disposed in the flower pot cover, thereby retaining the flower pot cover on the flower pot.

16. The apparatus of claim 15, wherein the female die further comprises:

a base section;

a middle section connected to and extending upwardly from the base section;

a sliding section slidably positioned within the middle section and biasingly supported relative to the base section; and a plurality of actuator assemblies, each actuator assembly connected to the sliding section and to a corresponding finger such that the fingers are caused to move radially inwardly in response to downward movement of the sliding section.

17. The apparatus of claim 16, wherein the plurality of actuator assemblies each comprise:

a cam rigidly attached to the sliding section;

a pivot arm pivotally attached to the middle section and having one end engageable with the cam and one end pivotally connected to one of the fingers such that the cam engages the pivot arm and pivots the pivot arm to cause the fingers to move radially inwardly in response to downward movement of the sliding section.

18. The apparatus of claim 15, wherein each of the fingers has an arcuate nub that substantially conforms to the contour of the recess of the male die.

19. The apparatus of claim 18, wherein the fingers are uniformly spaced around a circumference of the female die when the male die presses the sheet of material against the female die.

20. The apparatus of claim 19, wherein the arcuate nub of the fingers substantially circumscribe a circle when the nubs are positioned in the recess of the male die.

* * * * *